US009376855B2

(12) United States Patent
Baumert

(10) Patent No.: US 9,376,855 B2
(45) Date of Patent: Jun. 28, 2016

(54) PREHUNG FIRE DOOR UNIT WITH ONE OR TWO SWING DOOR LEAF OR LEAVES

(75) Inventor: Bernard Baumert, Schaeffersheim (FR)

(73) Assignee: BAUMERT, Schaeffersheim (FR)

( * ) Notice: Subject to any disclaimer, the term of this patent is extended or adjusted under 35 U.S.C. 154(b) by 0 days.

(21) Appl. No.: 13/703,194

(22) PCT Filed: Jun. 10, 2010

(86) PCT No.: PCT/FR2010/051156

§ 371 (c)(1),
(2), (4) Date: Dec. 10, 2012

(87) PCT Pub. No.: WO2011/154619

PCT Pub. Date: Dec. 15, 2011

(65) Prior Publication Data

US 2013/0074444 A1 Mar. 28, 2013

(30) Foreign Application Priority Data

Jun. 8, 2010 (FR) ..... 10 54503

(51) Int. Cl.
*E06B 5/16* (2006.01)
*E06B 1/60* (2006.01)
(Continued)

(52) U.S. Cl.
CPC . *E06B 5/16* (2013.01); *E06B 1/603* (2013.01); *E06B 5/162* (2013.01); *E06B 1/02* (2013.01);
(Continued)

(58) Field of Classification Search
CPC ..... E06B 5/16; E06B 5/162; E06B 1/603
USPC ..... 49/504, 501, 460, 462; 52/213, 215, 52/784.1, 656.3, 656.4, 656.6
See application file for complete search history.

(56) References Cited

U.S. PATENT DOCUMENTS 2,018,663 A * 10/1935 Fitch ..... 52/784.13
2,893,070 A * 7/1959 Gauthier ..... 49/399
(Continued)

FOREIGN PATENT DOCUMENTS

CN 1139174 A 1/1997
CN 2811522 Y 8/2006
(Continued)

OTHER PUBLICATIONS

DE202009006415 translation.*
(Continued)

*Primary Examiner* — Katherine Mitchell
*Assistant Examiner* — Marcus Menezes
(74) *Attorney, Agent, or Firm* — Carter, DeLuca, Farrell & Schmidt, LLP

(57) ABSTRACT

A prehung fire door unit with one or two swing door leaf or leaves intended to be mounted in an opening made in a stonework construction, rising up substantially vertically in a building. The prehung door unit includes a fixed frame and at least one door leaf, the fixed frame being able to be fitted, at least in part, into a recess made in the opening. The prehung door unit made of an assembly of profiled elements fitted end to end and each made from an elongate flat element made of rigid material having temperature and fire resistance properties and that can be applied, either directly or indirectly, against at least one of the closed end faces of the recess so as to create, in the closed end of the recess, an additional finishing and/or supporting thickness for each door leaf.

15 Claims, 3 Drawing Sheets

(51) Int. Cl.

| | |
|---|---|
| *E06B 1/02* | (2006.01) |
| *E06B 3/82* | (2006.01) |
| *E06B 3/70* | (2006.01) |

(52) U.S. Cl.

CPC ..... *E06B 3/822* (2013.01); *E06B 2003/7042* (2013.01); *E06B 2003/7046* (2013.01); *E06B 2003/7074* (2013.01); *E06B 2003/7094* (2013.01)

(56) References Cited

U.S. PATENT DOCUMENTS

| | | | | |
|---|---|---|---|---|
| 3,945,670 | A * | 3/1976 | Peterson | 292/92 |
| 4,674,248 | A * | 6/1987 | Hall | 52/212 |
| 5,070,650 | A * | 12/1991 | Anderson | 49/460 |
| 5,603,191 | A * | 2/1997 | Wu | 52/204.1 |
| 5,644,874 | A * | 7/1997 | McKann | 52/202 |
| 6,434,899 | B1 * | 8/2002 | Fortin et al. | 52/232 |
| 6,745,526 | B1 * | 6/2004 | Autovino | 52/232 |
| 7,134,246 | B1 * | 11/2006 | Olberding et al. | 52/210 |
| 2003/0005645 | A1 * | 1/2003 | Wang Chen | 49/501 |
| 2007/0222626 | A1 * | 9/2007 | Picard et al. | 340/584 |
| 2008/0120929 | A1 * | 5/2008 | Keith et al. | 52/204.1 |
| 2010/0059900 | A1 * | 3/2010 | Cushing et al. | 264/108 |

FOREIGN PATENT DOCUMENTS

| | | | | |
|---|---|---|---|---|
| DE | 196 25 643 | A1 | 1/1998 | |
| DE | 199 00 095 | C1 | 3/2000 | |
| DE | 20 2009 006415 | U1 | 7/2009 | |
| FR | 2386680 | A1 | 11/1978 | |
| FR | 2 426 143 | A1 | 12/1979 | |
| FR | 2701287 | A1 * | 8/1994 | E06B 1/02 |

OTHER PUBLICATIONS

DE19625643 translation.*
Machine translation of FR2386680.*
Machine translation of FR2701287.*
International Search Report issued in corresponding application No. PCT/FR2010/051156 mailed Apr. 26, 2011.
Chinese Office Action issued in corresponding application No. 201080067645.7 on Jul. 31, 2014.
Notification of the Second Office Action of Chinese Appln. No. 2010-800676457 dated Apr. 8, 2015.

* cited by examiner

PREHUNG FIRE DOOR UNIT WITH ONE OR TWO SWING DOOR LEAF OR LEAVES

BACKGROUND

The present invention relates to the field of fire protection in buildings and, in particular, high-security buildings, and relates to a fire door assembly having one or two swiveling door leaves.

It is known that in high-security buildings, particularly those using a nuclear source, must meet many requirements in response to accidental or intentional assaults such as fires.

To combat these assaults, it is known to implement fire door assemblies having one or two swiveling door leaves, thereby making it possible to prevent the disaster (fire or smoke) from spreading into the buildings concerned by compartmentation and confinement of the areas on fire, while dividing these buildings into various protected areas.

A current fire door assembly must thus meet several constraints and requirements such as fire stability (flame resistance), gas and smoke-proofness and heat insulation over a specific time period.

Such fire door assemblies are intended to be mounted in an opening or bay, which is specifically rectangular or square, and which is made in a masonry structure usually extending substantially vertically, such as a wall. They generally consist of a fixed frame extending substantially vertically when mounted in said bay, and comprising substantially two vertical uprights joined by a horizontal upper cross-member and by one or two door leaves each swiveling about a vertical axis by means of at least two loose-joint hinges, said fixed frame being capable of being at least partially inserted into a recess made in the opening of said bay and open outwardly, i.e., towards the area of travel of the or each door leaf.

Hereinbelow (or hereinafter), the visible and exposed surface in the state wherein said door assembly is mounted in the corresponding bay and in the closed position of the or each door leaf, relative to an observer situated in the area of travel of the or each door leaf, will be described as the front surface of the door assembly. The non-visible or unexposed surface thereof, in mounted state and closed position of each door leaf, relative to said observer, will be described as the rear surface of the door assembly.

Furthermore, in this type of fire door assembly, provisions are generally made for the door leaf to be provided with a rigid metal peripheral frame, in order to reinforce its structure and rigidity thereof, and for fire barriers and/or intumescent seals to be placed between the or each door leaf and the fixed frame or between the latter and the masonry structure, in order to make it possible to slow down rises in temperature and the spread of toxic fumes.

In addition, fire door assemblies must comply with regulations in force concerning fire safety and, in this regard, must be subject to fire tests during which temperature sensors or thermocouples are placed at various control points or reference areas on the door assembly, namely on the or each door leaf and/or on the fixed frame, specifically in proximity to the peripheral area of same and on the unexposed side generally corresponding to the rear surface of said door assembly.

Such being the case, measurements taken by said sensors on existing door assemblies, in particular according to the latest classifications of current standards, reveal significant increases in temperature, which do not enable effective fire resistance to be obtained for same. This is primarily due to the structure of the fixed frames and, where appropriate, those of the peripheral frames of the current door leaves, which are made of tubular metal profile members comprising many surfaces apparent or not, exposed to fire and increases in temperature, which do not enable the thermal bridge between the various constituent elements of the door assembly to be effectively broken and, in particular, between said exposed surfaces and the regulatory measurement areas where the sensors are placed.

SUMMARY

The aim of the present invention is to overcome these disadvantages by proposing a fire door assembly enabling the thermal bridge between the various constituent elements of said door to be effectively broken, and consequently a minimum rise in temperature thereof, in particular in the reference areas, in accordance with current fire protection regulations.

To that end, the present invention relates to a fire door assembly having one or two swiveling door leaves intended to be mounted in a bay, which is specifically rectangular or square, and which is made in a masonry structure, such as a wall, extending substantially vertically in a building and specifically in a high-security building, said door assembly consisting of a fixed frame comprising substantially two vertical uprights joined by a horizontal upper cross-member and by one or two door leaves each of which is pivotably mounted about a vertical axis by means of at least two loose-joint hinges, the or each door leaf optionally comprising a peripheral reinforcing or stiffening frame, said fixed frame being capable of being at least partially inserted into a recess made in the opening of said bay and open outwardly therefrom, and characterized substantially in that the fixed frame is made of an assemblage of end-to-end profile members, which are each made of an elongate and flat element made of a rigid material having temperature and fire-resistance properties, such as rigid sheet metal, optionally comprising a longitudinal fold capable of being directly or indirectly applied to at least one of the surfaces of the base of the recess, specifically the surface oriented substantially perpendicular to the plane of the or each door leaf in the closed position thereof, so as to create, at the base of the recess, a finishing and/or support allowance for the or each door leaf.

BRIEF DESCRIPTION OF THE DRAWINGS

The invention will be better understood owing to the following description, which relates to a preferred embodiment given for non-limiting exemplary purposes and explained with reference to the appended schematic drawings, in which.

DETAILED DESCRIPTION

Figure 1:
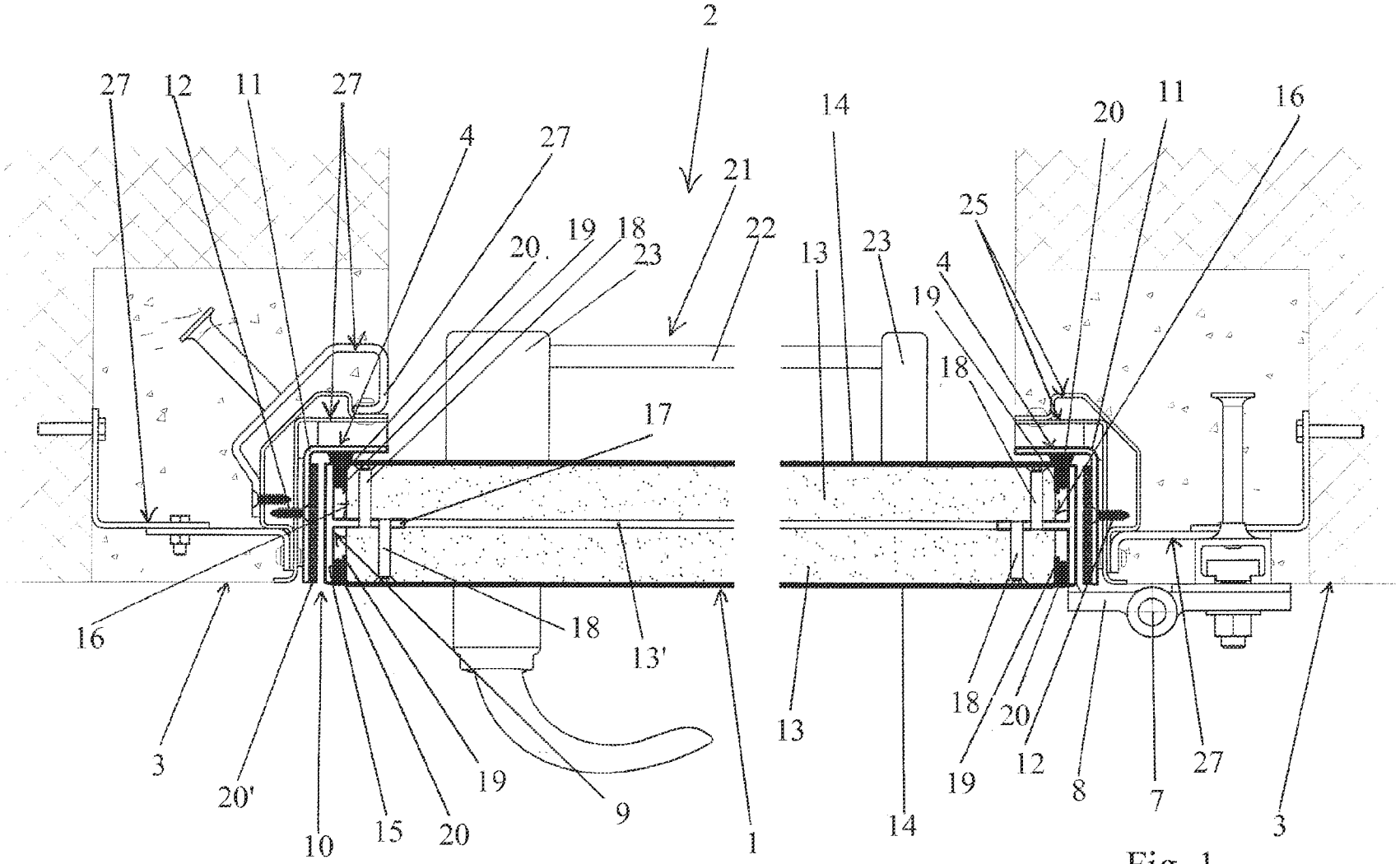
FIG. 1 shows an enlarged, partial, cross-sectional view, taken along the horizontal axis "H-H" shown in FIG. 3, of a preferred embodiment of a fire door assembly having a swiveling door leaf, according to the present invention, in the state wherein same is mounted in a bay of a masonry structure of a high-security building.

The figures show a fire door assembly according to the invention, which as a door leaf 1 intended to be mounted in a bay 2, which is specifically rectangular or square, and which is made in a masonry structure 3, such as a wall extending substantially vertically in a building, and specifically in a high-security building, said door assembly consisting, on the one hand, of a fixed frame 4 comprising substantially two vertical upright members 5 joined by a horizontal upper cross-member 6, and, on the other hand, a door leaf 1 mounted pivotably about a vertical axis 7, by means of at least two loose-joint hinges 8, the or each door leaf 1 optionally comprising a peripheral reinforcing or stiffening frame 9, said fixed frame 4 being capable of being at least partially inserted into a recess 10 made in the opening of said bay 2 and open towards the exterior thereof.

An opening of the recess 10 towards the exterior of the bay 2 is specifically understood to mean an opening towards the area of travel of one or each door leaf 1.

According to the present invention, the fixed frame 4 of such a door assembly is made of an assemblage of end-to-end profile members each of which is made of an elongate and flat element made of a rigid material having temperature and fire-resistance properties, such as rigid sheet metal, optionally comprising a longitudinal fold 11 capable of being directly or indirectly applied to at least one of the base surfaces of the recess 10, specifically the surface oriented substantially perpendicular to the plane of the or each door leaf 1, in the closed position thereof, so as to create, at the base of the recess 10, a finishing and/or support allowance for the or each door leaf 1.

It should be noted that a door assembly according to the invention can be likewise by of the type having two swiveling door leaves 1.

In a known manner, each profile member comprising the fixed frame 4, for example, can be beveled at 45° on at least one of the free ends thereof, so as to be capable of ensuring the abutment thereof, in order to form a U-shaped frame, of which the base of said U-shaped is intended to form the horizontal upper cross-member 6, and the inter-attachment thereof, for example, can be carried out by welding the free ends of same, in particular in the case of preferably metal profile members.

On the other hand, the present invention can further provide for means 12, such as screws, for attaching the fixed frame 4 to the recess 10, thereby enabling the spacing between the fixed frame 4 and the recess base 10 to be adjusted, in order to adjust a maximum degree of play between each door leaf 1 and said fixed frame 4 in said recess 10 in the closed position of the corresponding door leaf 1.

Preferably, each profile member of the fixed frame 4 can be folded longitudinally so as to have an overall L-shaped cross-section, and so as to be capable of being applied, in the mounted state, against the base of the recess 10 of the bay 2 while fitting substantially exactly to the shape of said base, which is normally L-shaped.

In addition, each door leaf 1 can include a peripheral reinforcing or stiffening frame 9 capable of receiving a filling structure 13, 14 and the peripheral frame 9 can be made of an assemblage of profile members placed end-to-end and each consisting of a preferably metal frame plate 15, or a preferably rectangular elongate flat element made of a similar material and having temperature and fire-resistance properties.

Furthermore, each frame plate 15 can be capable of being fixedly or rigidly attached along the edge 16 of one of the surfaces of the door leaf 1 concerned, substantially parallel to the plane containing same and, consequently, substantially perpendicular to the planes containing the large front or rear opposing surfaces of said door leaf 1.

In a preferred embodiment of the filling structure 13, 14, same can consist of one or two insulating panels 13, preferably made of a composite material. In the case of a filling structure 13, 14 with two panels 13, the latter can be rigidly held against one another or separated from one another by a space 13' creating air space the effect of which is to further reduce the shift in the temperature gradient.

Preferably, as can be seen in FIG. 1, each profile member of the peripheral frame 9 can have a T-shaped cross-section so as to form a frame plate 15 comprising an inner supporting and stiffening flange 17 extending perpendicularly relative to the frame plate 15, said inner flange 17 being capable of being inserted into the filling structure 13, 14, between the two insulating panels 13, which are rigidly held by attachment means 18, such as screws, thereby pressure-clamping said panels 13 to the corresponding surface of the inner flange 17 of the T-shaped profile member 15 in question.

In order to protect the composite panel or panels 13, the large front and/or rear surface(s) of the or each door leaf 1 can advantageously be covered with a facing (14), e.g., such as a sheet metal plate or other fire and temperature increase-resistant material.

Figure 2:
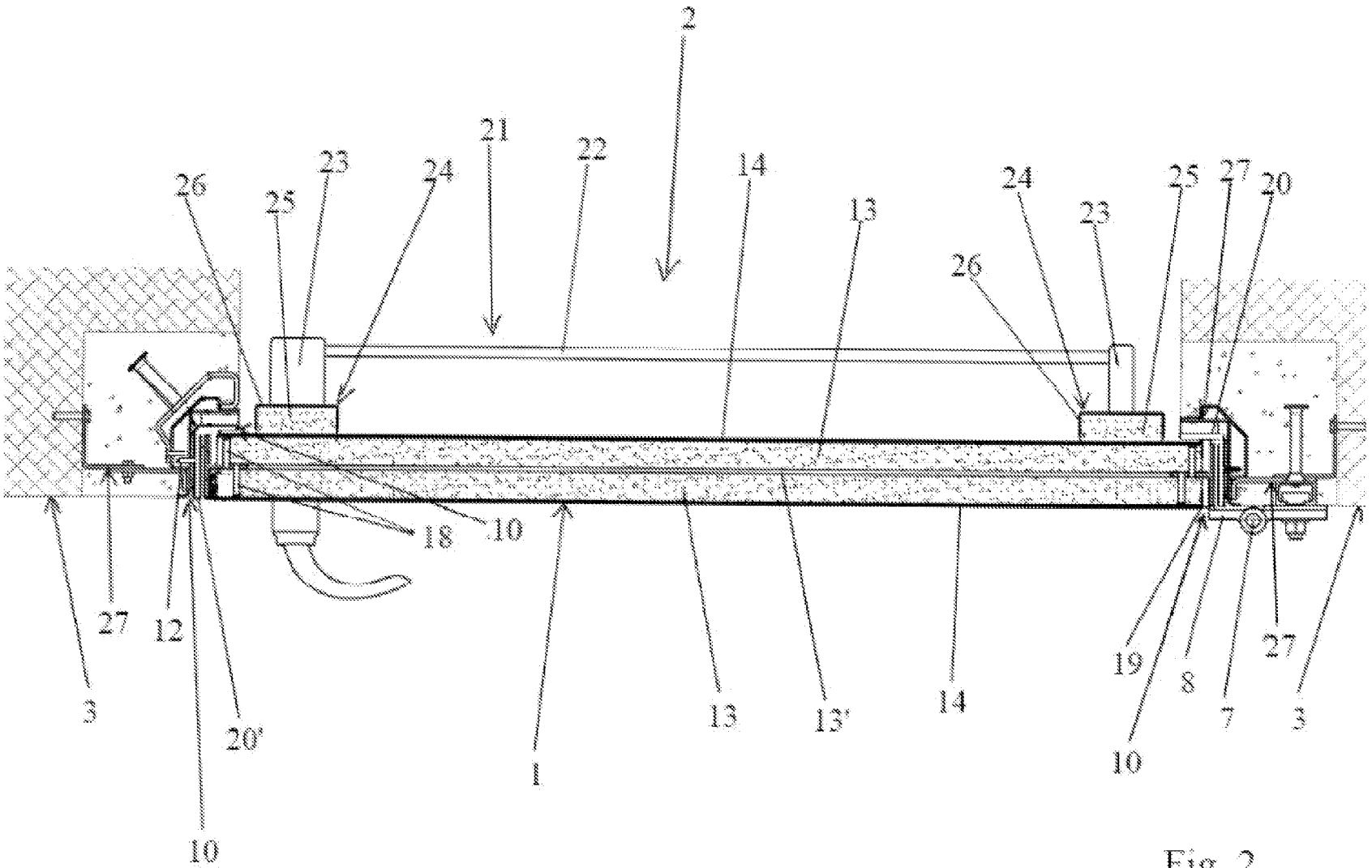
FIG. 2 shows a cross-sectional view, taken along the horizontal axis "H-H" shown in FIG. 3, of the fire door assembly having a swiveling door leaf, as shown in FIG. 1, wherein the panic bar system comprises protective support parts.
Figure 3:
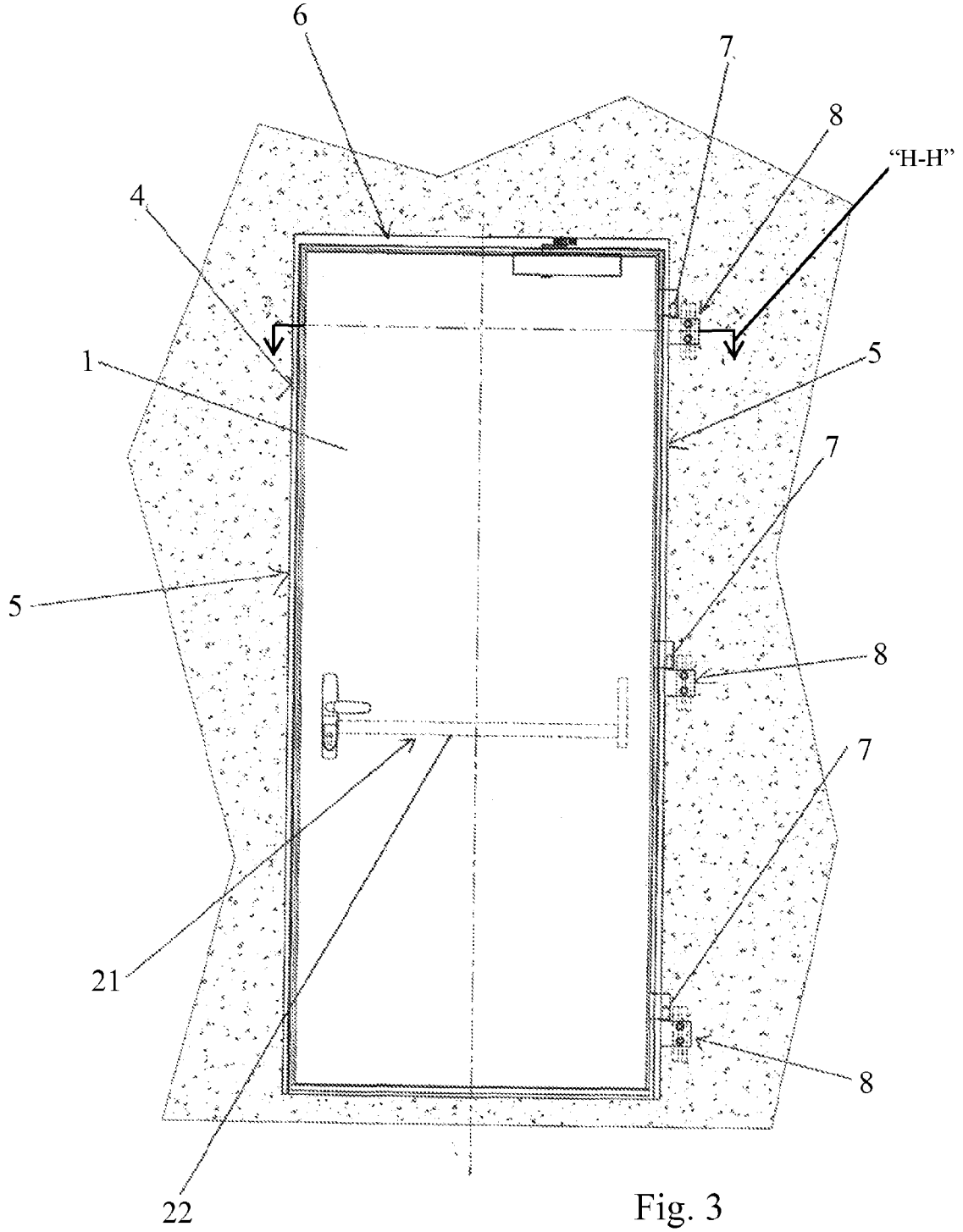
FIG. 3 shows a front view of the front surface of the door assembly mounted in the masonry structure of FIG. 1.

Furthermore, the present invention can provide for each facing 14 to be capable of being folded longitudinally at the peripheral edge thereof so as to form a return 19 capable of covering a portion of the corresponding edge 16 of said door leaf 1, without being in contact with the return of the other facing 14 covering the other large surface, in order to ensure rupture of the thermal bridge between the two front and rear facings 14, respectively (FIG. 1 and FIG. 2).

Each frame plate 15 of the peripheral frame 9 can preferably be situated at a distance from the corresponding edge 16 of the door leaf 1 concerned, and particularly, where appropriate, at a distance from the returns 19 of the facings 14, so as to ensure rupture of the thermal bridge between each frame plate 15 and the edge 16 or, where appropriate, the returns 19.

Preferably, the seals 20 can be inserted, preferably on the front surface side and rear surface side of the or each door leaf 1, between the frame plate 15 and the corresponding edge 16 of the or each door leaf 1. Specifically, a portion of said seals, preferably those situated rear surface side of the corresponding door leaf 1, are capable of coming into sealing contact with the fixed frame 4 in the closed position of said door leaf 1, while the other seals 20, preferably situated on the front surface side of the corresponding door leaf 1, can also have finishing function.

In addition, as can be seen in FIG. 1 in particular, intumescent seals 20' can cover all or part of the external surfaces of the fixed frame 4 and, preferably, the external surfaces situated opposite the corresponding edges 16 in a closed position of the or each door leaf 1 concerned.

On the other hand, in FIGS. 1 and 2, it can be seen that the axis of the release of play or of the gap forming a baffle, which is specifically L-shaped, between the or each door leaf 1 and the fixed frame 4 in the closed position of the or each door leaf 1, on the rear surface side of the door assembly, is substantially parallel to the rear surface or the or each door leaf 1, whereby the hot gases originating on the opposite side (front surface) of the door assembly, via said baffle, exit therefrom at the rear surface of the corresponding door leaf 1, substantially parallel to said rear surface and in contact therewith.

In order to protect the rear surface of the or each door leaf 1 from the hot gases thus exiting from the baffle of the recess 10, the present invention, as can be seen in FIG. 2, can provide for one or more protective fire barrier parts 24, having temperature and fire resistance properties, to be capable of being attached to the rear surface of the or each door leaf 1, so as to create fire barriers on said rear surface, which, in the closed state of the or each door leaf 1, are situated at the exit of the baffle of the recess 10. Such barriers can each extend, recessed from and close to one of the vertical or optionally upper or lower edges of the or each door leaf 1, and enable the hot gases exiting the baffle of the recess 10 at the rear surface and substantially parallel thereto, to be oriented in a direction substantially perpendicular to said rear surface and beyond same (FIG. 2). Thus, in the event of a surrounding disaster on the front surface side of the door assembly the unexposed rear surface is protected from any increase in temperature caused by direct contact between said rear surface and the hot gases, and fully meets the current fire protection standards.

It should be noted that, in the case of a disaster on the rear surface side of the door assembly, the front surface of the or each door leaf 1 is not affected by hot gases, unlike the previously described situation, since, in this case, the exit axis from the recess 10, on the front surface side, is oriented substantially perpendicular to the plane of the front surface, in the closed state of the or each door leaf 1, whereby the hot gases originating on the rear surface of the door assembly exit from the baffle of the recess 10, on said front surface, in the direction of said axis, i.e., substantially perpendicular to said front surface and beyond therefrom.

A panic bar system 21, or other similar known lock system, can be attached to one of the large front or rear surfaces, where appropriate, of the corresponding facing 14 of the or each door leaf 1, and can include a bar 22, e.g., such as an oval tube, which is attached at each of the ends thereof to the corresponding surface of the door leaf 1 concerned, by means of a main supporting part 23.

In the latter case, if reference is made to FIG. 2, it can be seen that two fire protection parts 24 of the or each door leaf 1 of the door assembly according to the present invention can each be arranged between one of the two main supporting parts 23 of the panic bar system 21, and the corresponding front or rear surface of the door leaf 1 concerned. It can likewise be seen that the width of each fire protection part 24 is greater than the width of each main supporting part 23. This is done so as to create a protection barrier on the rear surface of the or each door leaf 1, in the closed state of the or each door leaf 1, which is situated at the exit of each baffle of the recess 10 and which, on the one hand, enables the hot gases exiting said baffle at the corresponding rear surface of the or each door leaf 1 to be oriented in a direction substantially perpendicular thereto and beyond same, and, on the other hand, to prevent the hot gases from further coming into contact with or directly striking said main supporting parts 23 (FIG. 2), and to consequently limit the increases in temperature on the panic bar 22 concerned.

A fire protection part 24 can preferably consist of a core 25 made of a composite material, which is preferably coated, in particular, on the surfaces thereof that are likely to be exposed, by means of a facing 26, such as a metal sheet or other protective element resistant to fire and increases in temperature.

Finally, it can likewise be seen in the figures that the fixed frame 4 can be attached to the recess 10 of the bay 2 by means of a fixed subframe 27 anchor-sealed into the masonry structure 2, as described in French Patent Application No. 10 54476 of Jun. 8, 2010.

The invention is, of course, not limited to the embodiment described and shown in the appended drawings. Modifications remain possible, in particular as concerns the composition of the various elements or by substituting equivalent techniques, without thereby exceeding the scope of protection of the invention.

What is claimed is:

1. A system, comprising:

a bay extending substantially vertically, wherein the bay includes a recess defined by an opening and an L-shaped base, the L-shaped base defining first and second surfaces disposed in perpendicular orientation relative to one another; and a fire door assembly, including:

at least one swiveling door leaf including a front surface defining a plane orientated perpendicularly relative to the first surface of the L-shaped base in a closed position of the at least one swiveling door leaf; and a fixed frame made of a plurality of profile members including two substantially vertical uprights and a horizontal upper cross-member assembled end-to-end between the two substantially vertical uprights, each of the plurality of profile members made of an elongate and flat element of sheet metal and including a single L-shaped longitudinal fold, the at least one swiveling door leaf mounted pivotably to the fixed frame about a vertical axis by at least two hinges and the fixed frame fully inserted into the recess of the bay, wherein the single L-shaped longitudinal fold of each of the plurality of profile members enables complementary fitting of each of the plurality of profile members with the L-shaped base of the bay upon full insertion of the fixed frame into the recess of the bay, such that each of the plurality of profile members is fully inserted within the recess of the bay, and includes a first fold portion applied against the first surface of the L-shaped base of the bay in parallel orientation relative thereto, and a second fold portion spaced-apart from the second surface of the L-shaped base of the bay in parallel orientation relative thereto, wherein a distal end of the first fold portion of each of the plurality of profile members is co-planar with the front surface of the at least one swiveling door leaf, and wherein the fire door assembly is configured to be mounted in the bay.

2. The system according to claim 1, further comprising screws for attaching the fixed frame to the bay within the recess of the bay, thereby enabling spacing between the fixed frame and the base of the recess of the bay, in order to adjust a maximum degree of play between the at least one swiveling door leaf and the fixed frame in the recess of the bay in the closed position of the at least one swiveling door leaf.

3. The system according to claim 1, wherein the at least one swiveling door leaf includes a peripheral reinforcing and stiffening frame capable of receiving a filling structure, wherein the peripheral reinforcing and stiffening frame is made of at least one profile member, each profile member of the peripheral reinforcing and stiffening frame consisting of a frame plate, each frame plate being capable of being held along an edge of one side of the at least one swiveling door leaf, substantially parallel to the plane of the at least one swiveling door leaf.

4. The system according to claim 3, wherein the filling structure includes at least one insulating panel made of a composite material, and wherein a plurality of insulating panels of the filling structure are either held together or separated from one another by a space creating an air space to reduce a shift in gradient temperature.

5. The system according to claim 4, wherein each profile member of the peripheral reinforcing and stiffening frame has a T-shaped cross-section, so as to form the frame plate including an internal supporting and stiffening flange extending perpendicularly relative to the frame plate, the internal supporting and stiffening flange capable of being inserted into the filling structure, between the plurality of insulating panels, thereby pressure-clamping the plurality of insulating panels to a corresponding surface of the internal supporting and stiffening flange of the corresponding T-shaped cross-section profile member of the peripheral reinforcing and stiffening frame.

6. The system according to claim 1, wherein at least one of the front and a rear surface of the at least one swiveling door leaf is covered with a facing for protecting against fire and increases in temperature.

7. The system according to claim 6, wherein the facing of each of the front and the rear surface of the at least one swiveling door leaf is folded at a peripheral edge thereof so as to form a return capable of covering a portion of a corresponding edge of the at least one swiveling door leaf, without being in contact with another return of another facing covering the other surface, in order to ensure rupture of a thermal bridge between the facings of the front and the rear surfaces, respectively.

8. The system according to claim 7, wherein seals are inserted on a front surface side and a rear surface side of the at least one swiveling door leaf between each frame plate of the peripheral reinforcing and stiffening frame and the corresponding edge of the at least one swiveling door leaf.

9. The system according to claim 1, wherein a gap forming a baffle in the recess of the bay between the at least one door leaf and the fixed frame, in the closed position of the at least one swiveling door leaf, on a rear surface side of the fire door assembly, is substantially parallel to a rear surface of the at least one swiveling door leaf, and wherein at least one fire barrier part is attached to the rear surface of the at least one swiveling door leaf, the at least one fire barrier part capable of being positioned, in the closed position of the at least one swiveling door leaf, at an exit of the baffle of the recess of the bay, the at least one fire barrier part enabling hot gases exiting from the baffle at the rear surface to be oriented in a direction substantially perpendicular thereto and beyond therefrom.

10. The system according to claim 9, wherein the at least one swiveling door leaf includes a panic bar system, the panic bar system including a bar attached at each end thereof to the rear surface of the at least one swiveling door leaf, by a main supporting part, and wherein two fire protection parts are each arranged between one of two main supporting parts and the rear surface of the at least one swiveling door leaf, a width of each fire protection part being greater than a width of each main supporting part, so as to create a fire barrier on the rear surface of the at least one swiveling door leaf, which, in the closed position of the at least one swiveling door leaf, is situated at the exit of the baffle of the recess of the bay, and which, enables the hot gases exiting the baffle, beyond the rear surface of the at least one swiveling door leaf, to be oriented substantially perpendicular to the rear surface to prevent the hot gases from coming into contact with or directly striking against the main supporting parts to thereby limit increases in temperature on the panic bar system.

11. The system according to claim 9, wherein each fire protection part includes a core made of a composite material that is at least partially covered by a facing.

12. The system according to claim 1, wherein the base of the recess of the bay includes a side oriented substantially perpendicular to the plane of the at least one swiveling door leaf in closed position, so as to create, at the base of the recess of the bay, at least one of a finishing or support allowance for the at least one swiveling door leaf.

13. The system according to claim 1, wherein the bay is made in a masonry structure.

14. The system according to claim 6, wherein the facing is a metal sheet.

15. The system according to claim 9, wherein the gap forming the baffle in the recess of the bay is L-shaped.

* * * * *